United States Patent [19]

Tausch

[11] 4,106,564

[45] Aug. 15, 1978

[54] SIDEPOCKET MANDREL

[75] Inventor: Gilbert H. Tausch, Sugar Land, Tex.

[73] Assignee: Camco, Incorporated, Houston, Tex.

[21] Appl. No.: 848,053

[22] Filed: Nov. 3, 1977

[51] Int. Cl.[2] ..... E21B 23/00

[52] U.S. Cl. ..... 166/117.5

[58] Field of Search ..... 166/117.5

[56] References Cited

U.S. PATENT DOCUMENTS

| | | | |
|---|---|---|---|
| 3,727,683 | 4/1973 | Terral et al. | 166/117.5 |
| 3,741,299 | 6/1973 | Terral | 166/117.5 |
| 4,030,543 | 6/1977 | McGinn | 166/117.5 |

*Primary Examiner*—James A. Leppink
*Attorney, Agent, or Firm*—Fulbright & Jaworski

[57] ABSTRACT

A mandrel for use in a well tubing in which the mandrel body has an open bore for alignment with the well tubing and a sidepocket offset from the open bore for receiving flow control devices. An integrally forged sub is welded to the top of the body and includes an actuating shoulder angularly spaced from the axis of the offset pocket a predetermined amount and a guide surface is positioned below the shoulder and directed upwardly towards the shoulder. A deflector guide is positioned in the offset bore above the pocket and includes a pair of rails forming a guide path which allows the entrance of flow control devices in the pocket but prevents the entrance of open bore tools into the guide path. The deflector guide and the pocket are telescopically secured to each other by coacting flat surfaces for insuring transverse alignment therebetween and include abutting coacting shoulders for maintaining proper axial spacing between the locking lug and the pocket.

3 Claims, 9 Drawing Figures

Fig. 1C
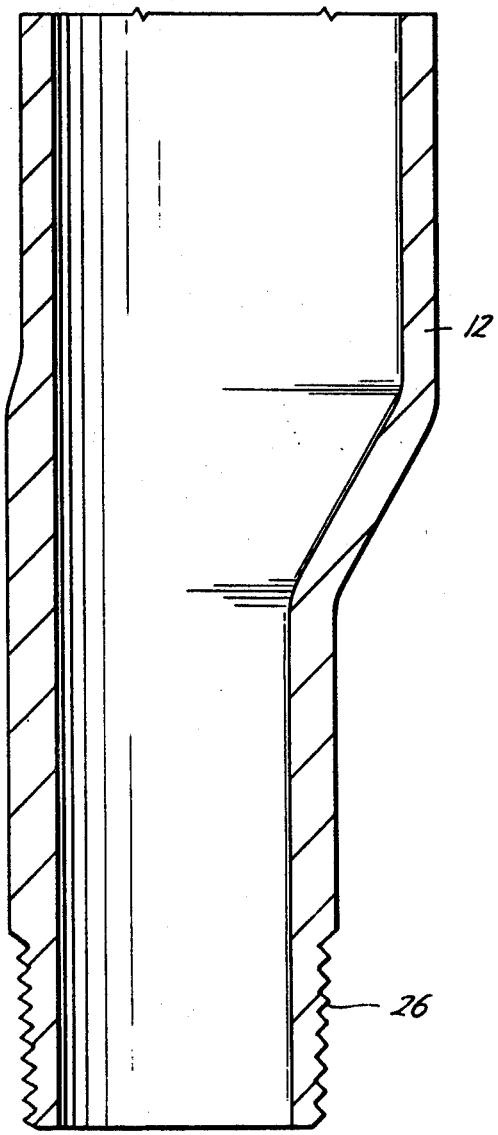
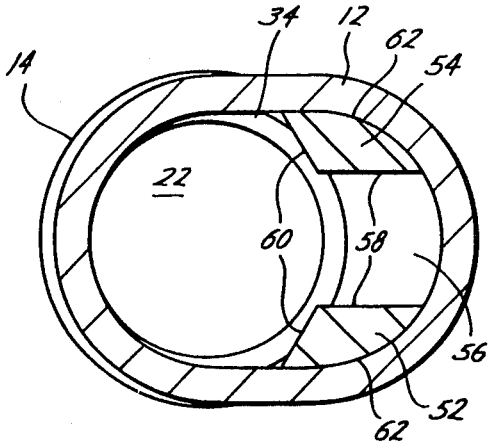
Fig. 2
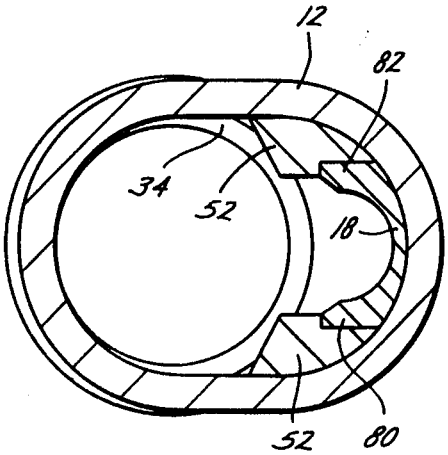
Fig. 3

SIDEPOCKET MANDREL

BACKGROUND OF THE INVENTION

Generally, a mandrel for use in a well tubing having an orienting sleeve for alingning a kickover tool for inserting or removing flow control devices from the sidepocket of the mandrel and a deflector guide in the mandrel above the pocket is generally shown in U.S. Pat. No. 3,741,299.

However, it is the present practice to separately make the orienting sleeve and weld it through an opening made in the top of the mandrel which creates crevices subject to corrosion, creates the possibility of leaks through the mandrel wall through which the sleeve is welded, creates the possibility of misalignment of the sleeve both radially and longitudinally, and creates the possibility of the lower pointed end of the sleeve being bent outward into the open bore and catching well tools moving upwardly through the bore. In addition, proper alignment, both axially and transversely between the deflector guide and the sidepocket has proved difficult to obtain in the structures being presently marketed. And since the mandrel is frequently used for years in a well, another industry concern is that the locking shoulder may in some wells corrode and fail to securely hold the flow control device in the sidepocket. The present invention is directed to an improved mandrel which reduces the problems noted in the prior art devices.

SUMMARY

The present invention is directed to a sidepocket mandrel in which the mandrel body has an open bore extending therethrough for alignment with well tubing and an offset bore adjacent the open bore in which a deflector guide, locking shoulder and pocket are positioned in the offset bore. One feature of the present invention includes an integrally forged sub welded to the top of the body in which the forged sub includes an actuating shoulder angularly spaced from the axis of the offset body a predetermined amount, and a guide surface positioned below the shoulder and directed upwardly and towards the shoulder thereby avoiding many of the disadvantages of the conventionally welded orienting sleeves of the prior art.

Another feature of the present invention is the provision of a deflector guide positioned in the offset bore above the pocket and having a pair of rails forming a guide path for guiding a flow control device into the pocket and deflecting open bore tools from the offset bore in which the deflector guide and the pocket are telescopically secured together for insuring alignment therebetween. The telescoping connection between the deflector guide and the pocket may include coacting flat surfaces between the deflector guide and the pocket for maintaining transverse alignment and may include abutting axial shoulders for maintaining proper axial spacing between the locking lug and the pocket.

Still a further object of the present invention is the provision of a locking lug being of a material having a greater resistance to corrosion than the normal steel components used in mandrel.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIGS. 1A, 1B and 1C are continuations of a elevational view, in cross section, of the mandrel of the present invention, FIG. 2 is a cross-sectional view taken along the line 2—2 of FIG. 1B, FIG. 3 is a cross-sectional view taken along the line 3—3 of FIG. 1B.

DESCRIPTION OF THE PREFERRED EMBODIMENT

Figure 1A:
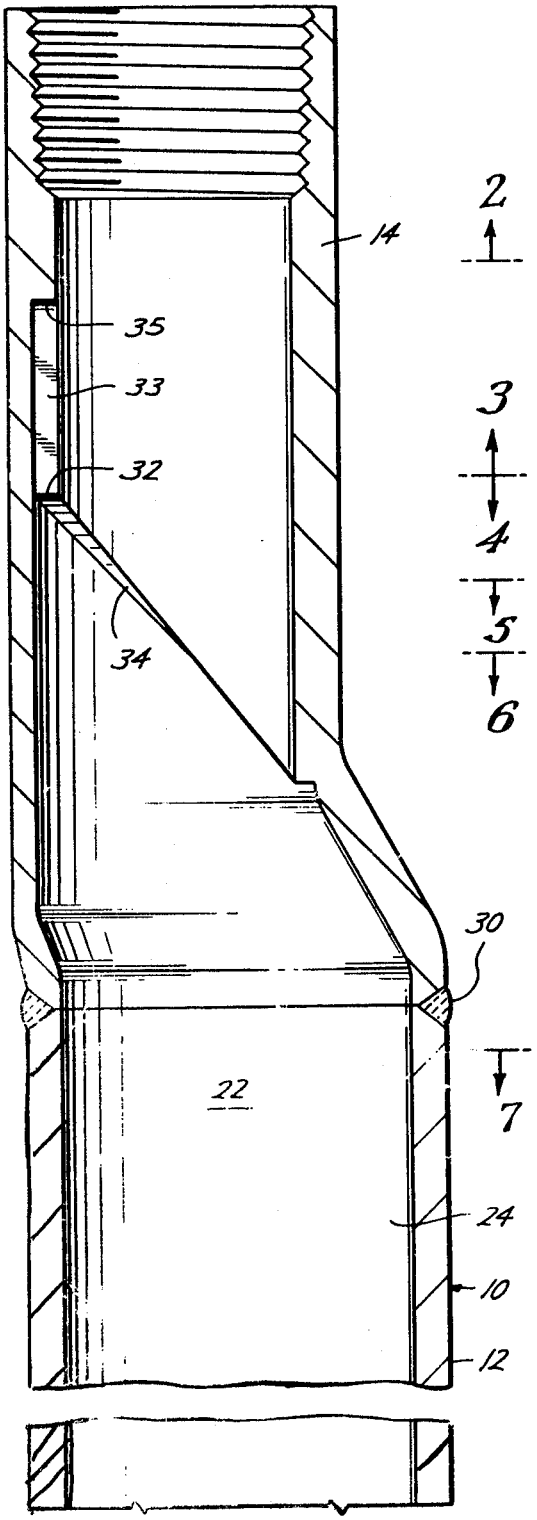
Figure 1B:
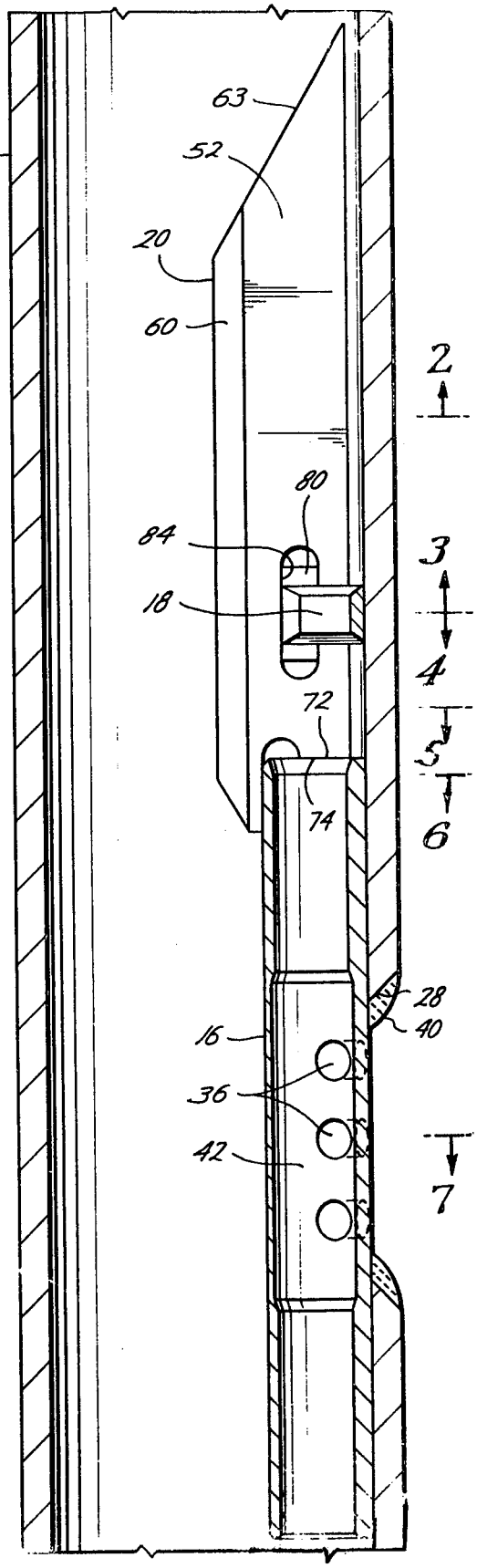

Referring now to the drawings, particularly to FIGS. 1A, 1B, and 1C, the reference numeral 10 generally indicates the improved mandrel of the present invention which generally includes a body 12, a sub 14, a sidepocket 16, a locking lug or shoulder 18, and a deflector guide 20.

The body 12 includes an open bore 22 extending therethrough for alignment with a well tubing into which the mandrel is inserted and also includes an offset bore 24. The lower end of the body 12 includes threads 26 for connection to the well tubing. The body further includes an opening 28 in communication with the offset bore 24 and the sidepocket 16.

One feature of the present invention is the provision of the sub 14 which is integrally forged and welded by a weld 30 to the top of the body 12. In the preferred embodiment, the forged sub 14 includes an actuating shoulder 32 angularly spaced from the axis of the offset pocket 16 a predetermined amount for actuating a conventional kickover tool for installing or removing a flow control device from the pocket 16, for example, a tool such as described in U.S. Pat. No. 3,827,490. In addition, the forged sub 14 includes a guide surface 34 positioned below the shoulder 32 and directed upwardly and towards said shoulder 32 for orientating the kickover tool relative to the sidepocket 16. Prior art patents such as U.S. Pat. No. 3,741,299 disclose the use of a separate orienting sleeve having an actuating shoulder, a slot, and a guide surface, which sleeve is welded into the top of a mandrel. However, the use of a forged sub insures that there are no crevices subject to corrosion, a stronger orienting structure is provided, and misalignment of the sleeve, both radially and longitudinally, is avoided, the possibility of leaks through the sidewall of the mandrel for welding the sleeve is avoided, and the possibility of the lower point of the sleeve being bent out into the open bore 22 and catching on well tools does not occur. While a longitudinal slot 33 can be placed in the forged sub 14 between an actuating shoulder 35 and the guide surface 34, as in the prior art sleeves, such a sot 33 is not required as the deflector guide 20 is sufficient to provide the guiding structure for insuring that a flow control valve is guided into the sidepocket 16.

Figure 7:
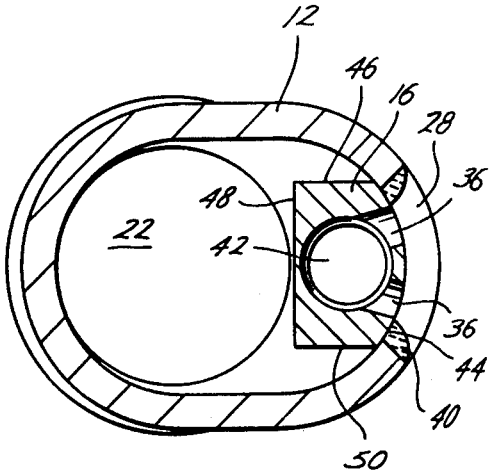
FIG. 7 is a cross-sectional view taken along the line 7—7 of FIG. 1B.

Referring now to FIGS. 1B and 7, the pocket 16 is positioned in the open bore 24, adjacent the body opening 28, and includes a plurality of ports 36 for admitting or expelling fluids between the interior and exterior of the mandrel 10 as is conventional. The pocket 16 is positioned inside of the mandrel body 12 and is secured in place adjacent the opening 28 by suitable welds 40 around the periphery of the window 28. The pocket 16, as is conventional, is adapted to receive a flow control device such as a valve in the sidepocket opening 42. Preferably, the sidepocket 16 includes one side 44 which is shaped to conform to the inside of the body 12 and second, third and fourth sides 46, 48, and 50 which are preferably flat for reasons to be hereinafter discussed.

Referring now to FIGS. 1B and 2–6, the deflector guide 20 is best seen for protecting flow control devices seated in the pocket 16 from damage by open bore well tools moving through the open bore 22, prevents the open bore tools from catching on the flow control devices, and guides the oriented flow control devices towards the sidepocket 16. The deflector guide 24 is positioned in the offset bore 24 and its axis is aligned with the axis of the offset pocket 16. Preferably, the deflector guide 20 includes a pair of rails 52 and 54 forming a guide path 56 therebetween. The guide path 56 is aligned above the sidepocket 16 and is sized to receive any flow control device to be seated in the pocket 16 but prevents the entrance of open bore tools into the guide path 56. Preferably, the rails 52 and 54 include longitudinal sides 58 on either side of the guide path 56, flat deflecting sides 60 which are transversely directed towards the guide path 56 for guiding well flow control devices into the guide path 56 and side 62 shaped to conform to the inside of the mandrel body 12 in the offset portion 24. And as best seen in FIG. 1B, the top 63 of the deflector guide 20 extends upwardly and outwardly from the open bore 22 for providing a deflection surface which prevents open bore tools from catching on the guide 20 or on any flow control device seated in th pocket 16.

Figure 6:
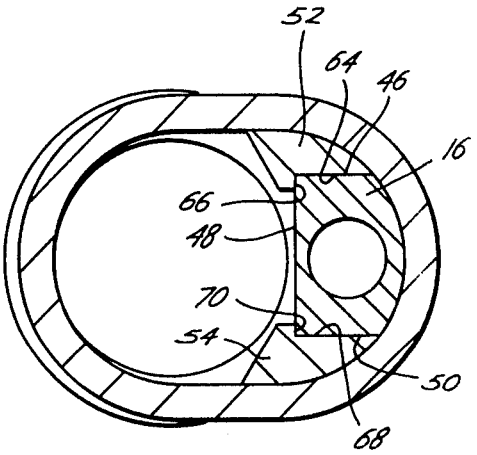
FIG. 6 is a cross-sectional view taken along the line 6—6 of FIG. 1B.
Figure 5:
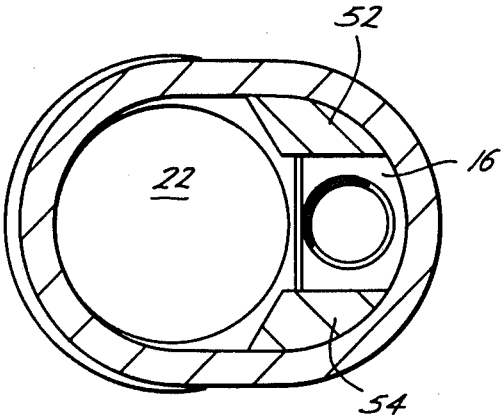
FIG. 5 is a cross-sectional view taken along the line 5—5 of FIG. 1B.

Referring now to FIGS. 1B, 5 and 6, it is to be noted that the deflector guide 20 and the sidepocket 16 are telescopically secured together for insuring alignment therebetween. As has previously discussed, sidepocket 16 includes flat longitudinally extending sides 46, 48 that coact with longitudinally extending flat sides 64 and 66 on the rail 52 and the longitudinally extending flat sides 48 and 50 of the pocket 16 coact with longitudinally extending flat sides 68 and 70 of the rail 54. The coacting flat surfaces between the rails 52 and 54 and the sidepocket 16 insure the alignment between the guide deflector 20 and the sidepocket 16 in all horizontal directions. Referring to FIG. 1B, coacting abutting vertical shoulders are provided such as shoulder 72 on the sidepocket 16 and shoulder 74 on each of the rails 52 and 54 for insuring correct vertical spacing of the deflector guide 20 and the sidepocket 16. This becomes important in insuring that the sidepocket 16 is properly spaced with reference to the locking lug or shoulder 18. While, of course, the guide 20 and the sidepocket 16 may be made integrally, it is preferred that they be made separately and joined, such as by welding, prior to insertion into the body 12 of the mandrel and are thereafter secured on the inside of the mandrel body 12 by the welds 40 and by tack welding the rails 52 and 54 to the interior of the body 12.

Figure 4:
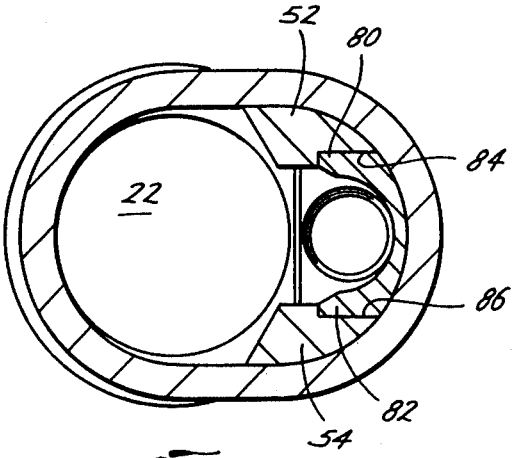
FIG. 4 is a cross-sectional view taken along the line 4—4 of FIG. 1B.

It has been the practice to make all components of the mandrel 10 out of steel. However, since a mandrel may be utilized many years in an oil well, there has been concern that due to the corrosiveness of well fluids that portions of the mandrel may corrode and deteriorate. Since the size of the locking lugs 18 is somewhat critical, there has been a concern that the locking shoulder 18 would corrode and fail to hold a flow control device in th pocket 16. Another feature of the present invention is providing a locking shoulder or locking lug 18 of a material having a greater resistance to corrosion, such as monel, which will insure that the shoulder or lug 18 will continue to provide a locking surface for holding flow control devices in the pocket 16 for long periods of time even when subjected to corrosive well fluids. While the locking lug 18 may be secured in any desired manner, such being integrally made with the rails 52 and 54, the lug 18 may, as best seen in FIGS. 1B, 3 and 4, be provided with keys 80 and 82 on either side for insertion into coacting keyways 84 in the rail 52 and 86 in the rail 54. If desired, the locking lug 18 may be further secured to the rails 52 and 54 by welding.

In use, flow control devices may be conventionally installed and removed from the offset sidepocket 16 by a suitable kickover tool as more fully described in U.S. Pat. No. 3,741,299.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, may be made which will readily suggest themselves to those skilled in the art and which are encompassed by the spirit of the invention and the scope of the appended claims.

What is claimed is:

1. A mandrel for use in a well tubing having a body having an open bore extending therethrough for alignment with the well tubing and having an offset bore adjacent the open bore, said body having an opening in communication with the offset bore, said body having a top and bottom adapted to be connected to well tubing, orientation means in the top in the open bore, a valve pocket positioned inside the body in the offset bore and besides the body opening for receiving flow control devices, a deflector guide positioned in the offset bore above the pocket and having a pair of rails forming a guide path therebetween for allowing the entrance of flow control devices into said pocket but preventing the entrance of open bore tools into the guide path, the top of the deflector guide extending upwardly and outwardly from the open bore for providing a deflecting surface which prevents open bore tools from catching on the guide or on any device in the pocket, and a locking lug secured to the deflector guide above said pocket, the improvement comprising said deflector guide and said pocket being telescopically secured together for insuring alignment therebetween.

2. The apparatus of claim 1 wherein the outside of the valve pocket includes two flat surfaces generally perpendicular to each other in a transverse direction and telescoping with coacting flat surfaces on each rail whereby transverse alignment between the pocket and the deflector guide is maintained.

3. The apparatus of claim 2 including abutting coacting shoulders between the pocket and said rails for maintaining proper axially spacing between the locking lug and said pocket.

* * * * *